US006019581A

United States Patent [19]

von Schulz-Hausmann et al.

[11] Patent Number: 6,019,581

[45] Date of Patent: Feb. 1, 2000

[54] FRICTION VACUUM PUMP WITH COOLING ARRANGEMENT

[75] Inventors: Friedrich von Schulz-Hausmann, Bonn; Wilhelm Walter, Kerpen; Heinrich Englander, Linnich, all of Germany

[73] Assignee: Leybold Aktiengesellschaft, Germany

[21] Appl. No.: 08/633,827

[22] PCT Filed: Aug. 8, 1995

[86] PCT No.: PCT/EP95/03140

§ 371 Date: Oct. 15, 1996

§ 102(e) Date: Oct. 15, 1996

[87] PCT Pub. No.: WO96/13667

PCT Pub. Date: May 9, 1996

[51] Int. Cl.[7] ..... F04B 17/00

[52] U.S. Cl. ..... 417/423.4; 417/368

[58] Field of Search ..... 417/423.4, 368; 310/58, 63, 62, 59, 60 R

[56] References Cited

U.S. PATENT DOCUMENTS

| | | | |
|---|---|---|---|
| 3,250,926 | 5/1966 | O'Reilly et al. | 310/59 |
| 4,541,772 | 9/1985 | Becker | 415/90 |
| 4,742,257 | 5/1988 | Carpenter | 310/62 |
| 4,908,538 | 3/1990 | Gerberth, Jr. | 310/63 |
| 4,992,687 | 2/1991 | Nel | 310/63 |
| 5,166,566 | 11/1992 | Bernhardt et al. | 417/423.4 |
| 5,662,456 | 9/1997 | Englander | 417/423.4 |

FOREIGN PATENT DOCUMENTS

| | | | |
|---|---|---|---|
| 1257795 | 10/1989 | Japan | 417/423.4 |
| 4246288 | 9/1992 | Japan | 417/423.4 |
| 5106587 | 4/1993 | Japan | 417/423.4 |
| 2232205 | of 1989 | United Kingdom . | |

*Primary Examiner*—Bibhu Mohanty
*Attorney, Agent, or Firm*—Wall Marjama Bilinski & Burr

[57] ABSTRACT

The invention relates to a single flow friction vacuum pump (1) with a housing (4, 5) in which an inlet (2), the active pumping surfaces (8, 9) and a drive motor (11) are arranged axially behind each other; in order to effectively air-cool the pump, it is proposed that its housing walls be equipped with air intake and air discharge openings and that a fan (23) be integrated in its housing (4, 5). (Drawing FIG. 1)

14 Claims, 2 Drawing Sheets

FRICTION VACUUM PUMP WITH COOLING ARRANGEMENT

BACKGROUND OF THE INVENTION

The invention relates to a single flow friction vacuum pump with a housing in which an inlet, the active pumping surfaces and a drive motor are arranged axially behind each other.

A friction vacuum pump of this kind is known from DE-U-80 27 697. During operation of pumps of this kind a cooling arrangement is generally necessary. Water cooling is on the one hand very effective, but on the other hand makes operation of the pump dependant on the presence of a cooling water supply connection. Moreover, design complexity required for the water cooling arrangement at the pump itself is relatively high. Moreover, it is known to employ a separate air cooling unit with a fan which is installable to the outside of the pump housing. On the one hand, such a cooling unit will only cool the outer surface of the pump housing, i.e. its cooling effect is restricted. On the other hand, additional installation work is necessary when cooling is required.

SUMMARY OF THE INVENTION

It is the task of the present invention to equip a friction vacuum pump of the aforementioned kind with an improved air cooling arrangement which is easier to handle.

According to the present invention this task is solved by equipping its housing walls with air intake and air discharge openings and so that a fan is integrated in its housing.

In a so designed pump, installation work is no longer necessary when cooling is required. Since the fan is situated in the housing, preferably at the side next to the drive motor, the cooling effect is particularly good. The cooled surface of the pump is more effective than otherwise possible through outer (orientation dependant) cooling fins. Moreover, the surface available for the transfer of heat is significantly larger compared to an outside surface with fins, since also the inside surface of the housing contributes to the cooling effect. The additional fan which may be switched on as required, supplies the air directly to those locations which generate heat and are thus at the highest temperature level. Thus the "cooling chain" (thermal transitions, thermally conducting paths, thermal capacities, thermal passages etc.) through which the heat has to be transported according to the state-of-the-art, becomes shorter at a steadily reducing temperature level, so that the additional fan may be of a smaller rating and may thus even be integrated into the pump.

Preferably the built-in fan is operated in such a manner that it is controlled by a temperature sensor. The pump is thus at all times protected against an undesirable temperature increase.

If inlet openings for the cold air supply, and discharge openings to discharge the warm air are provided in the housing walls of the pump, it is then possible to attain a chimney effect by skillfully admitting the flow, so that the flow passes the wall from the inside to the outside thereby creating a natural force-ventilation arrangement. This cools in addition and more effectively compared to the free convection which is present in any case at the outside of the wall. The air passage is so selected that the cooling effect is independent of the pump's orientation. Owing to the cone-shaped housing design, the air flow is not obstructed by neighbouring parts even if the pump is installed in a system. Moreover, there is sufficient space in the area of the drive to accommodate all necessary components, the fan among others, in the housing while keeping the axial dimension short.

Further advantages and details of the present invention shall be explained based on the design examples presented in drawing FIGS. 1 to 6.

BRIEF DESCRIPTION OF THE DRAWINGS

For a better understanding of the invention, reference shall be made to the following detailed description of the invention which is to be read in association with the accompanying drawings, wherein.

DESCRIPTION OF THE INVENTION

Figure 1:
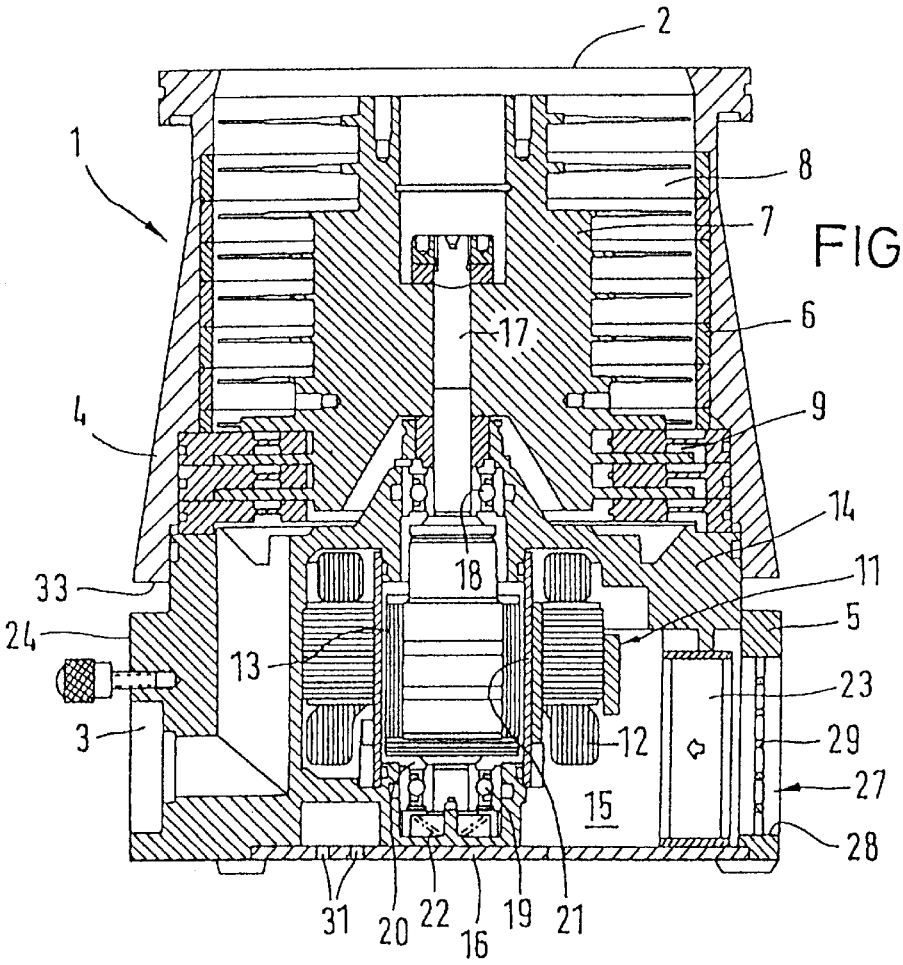
FIG. 1 is an elevational view in section showing a pump embodying the teachings of the present invention.

In all design examples presented in drawing FIGS. 1 to 6, the pump is marked 1, its inlet 2 and its discharge 3. The housing of the pump 1 comprises the two sections 4 and 5.

Figure 4:
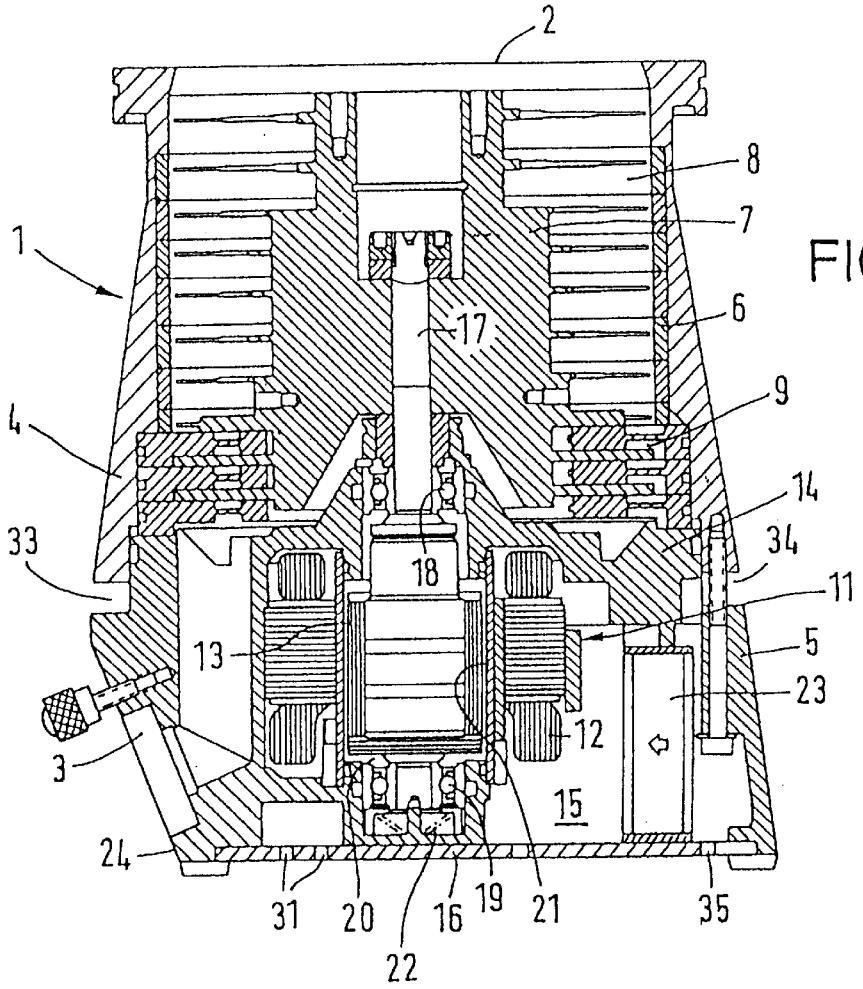
FIGS. 4–6 show a further embodiment of the invention wherein the plane forming the connection surface of the device is at an angle with the pump shaft.

The housing section 4 surrounds the stator 6 and the rotor 7 of the friction pump. Drawing FIGS. 1 and 4 show that turbomolecular stages 8 and Siegbahn pumping stages 9 are parts of the friction pump.

The housing section 5 surrounds the drive motor 11, its stator is marked 12 and its rotor is marked 13. The housing section 5 is part of a chassis 14 with the inside chamber 15, in which the drive motor 11 and further components are situated. Moreover, chassis 14 is the carrier for all further components of the pump 1. On the face side opposite to inlet 2, the inside chamber 15 is covered by the disc 16.

In chassis 14 also the shaft 17 which carries the rotor 7 runs on bearings, in such a manner that the rotor 13 of the drive motor 11 is situated between its bearings 18 and 19. The rotor 13 is situated within a chamber 20 which is formed by chassis 14 and a can 21. This space 20 is air-tight with respect to the outside. Thus the rotor 13 of the drive motor 11 runs in a vacuum, whereas the motor's stator 12 is situated outside of the vacuum. Therefore no gas-tight seal is necessary.

Situated within chamber 20 is also the spring 22, which serves the purpose of producing the bearing forces. It is assigned to the face side of the shaft 17 on the side of the drive and is designed as a helical spring having a conical shape. In comparison to the disc springs employed in this area, a conically designed helical spring has a much flatter characteristic so that a substantially constant force is ensured which is independent of tolerances. Compared to cylindically shaped helical springs, a conically designed helical spring has the advantage that its axial length is less.

The outside of the entire pump 1 is of a substantially conical design. The cross section of its housing or its housing sections 4, 5 opens out from the inlet side 2 to the side of the drive. This measure allows for an axially short design since on the side of the drive there is sufficient space available for arranging the components there next to each other.

Among other items, a fan 23 is situated in the inside chamber 15 of chassis 14. It is arranged at the side next to the drive motor 11 and may be either running continuously or may be controlled by a temperature sensor which is not shown. Thus sufficient cooling of the pump, its drive motor 11 in particular, is ensured.

Finally all the design examples presented in the drawing FIGS. 1 to 6 are equipped with a flat connection surface 24. This results from a sectional plane at the housing section 5. Concentrated on the connection surface 24 are all controls (fore-vacuum connection 3, plug 25 for the frequency converter, venting connection 26) and thus these are accessible and easy to handle regardless of the pump's orientation.

Figure 2:
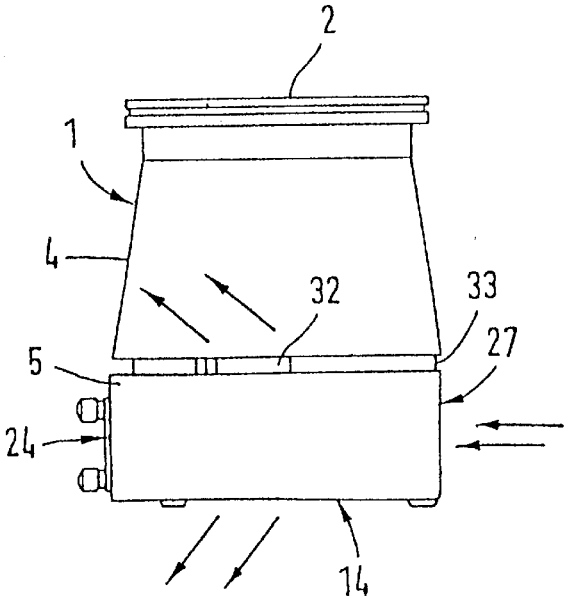
FIG. 2 is a side elevation of the pump further indicating air flow through the pump.
Figure 3:
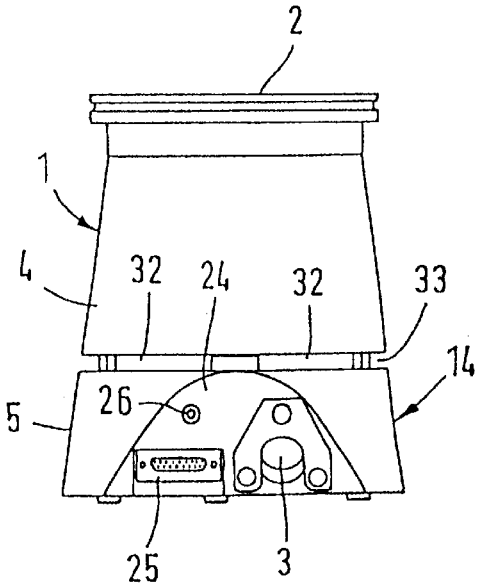
FIG. 3 is a further side elevation with portions broken away to show the pump controls.

In the design examples according to drawing FIGS. 1 to 3 the plane creating the connection surface 24 extends in parallel to shaft 17 of the pump 1. On the side of chassis 5 opposite to the connection surface 24 there is also provided a flat surface 27 with an opening 28. This opening 28 which is equipped with a grid 29 serves as the intake opening for the fan 23 arranged next to it. The sucked in cooling air exits again through openings 31 and 32 after having passed around the drive motor 11. The openings 31 are situated in disc 16 which covers the inside chamber 15 of chassis 14. The openings 32 lead out into a groove 33 which is situated between the housing sections 4 and 5.

Figure 5:
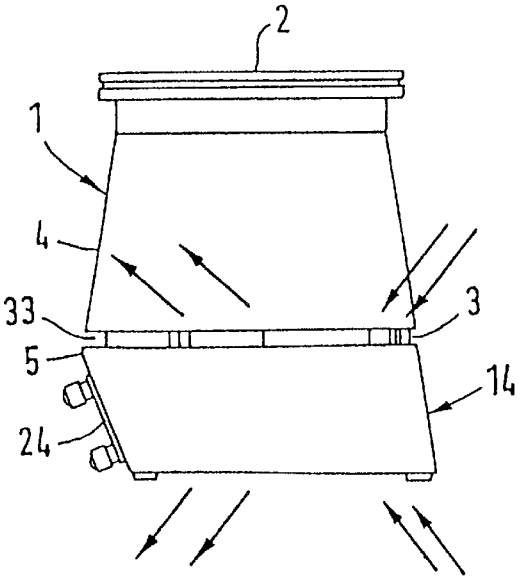
Figure 6:
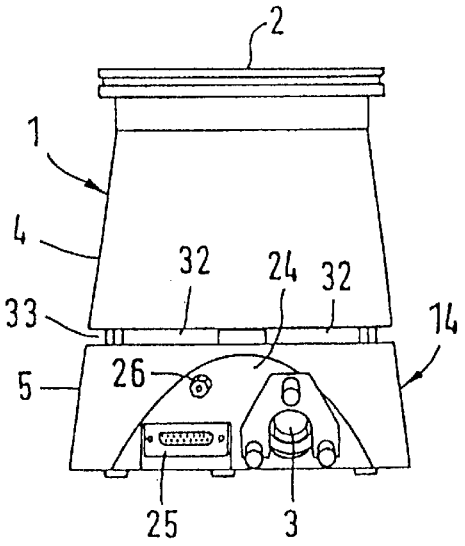

In the design examples according to drawing FIGS. 4 to 6 the plane forming the connection surface 24 forms an angle with respect to shaft 17, in such a manner that the connection surface 24 is larger compared to the connection surface 24 for the design examples according to drawing FIGS. 1 to 3. Moreover, the intake openings 34 and 35 related to the fan 23 are also situated in disc 16 or in the groove 33.

We claim:

1. A pump comprising:

a housing containing an air inlet, a single flow fraction vacuum pump with an active pumping surface, and a drive motor that are positioned axially one behind the other in the direction of extension of the axis of said drive motor;

a housing wall that contains an air intake opening and an air discharge opening; and an air fan integrated within the housing and positioned such that the axis of said air fan is substantially perpendicular to the axis of said drive motor.

2. Pump according to claim 1, wherein the fan (23) is situated at the side next to the drive motor (11).

3. Pump according to claim 1, wherein its housing (4, 5) is designed to have two sections, housing section (4) surrounding a stator (6) and a rotor (7), and housing section (5) surrounding the drive motor (11).

4. Pump according to claim 3, wherein the housing section (5) is part of a chassis (14) with the inside chamber (15) in which the drive motor (11) is situated, and the open face side of the inside chamber (15) being covered by a disc (16).

5. Pump according to claim 4, wherein the disc (16) is equipped with air inlet openings (35) and air discharge openings (31).

6. Pump according to claim 5, wherein the air inlet openings (34) and the air discharge openings (32) lead out into a surrounding groove (33) in the housing of the pump (1).

7. Pump according to claim 6 wherein the groove (33) is situated between the two sections of the housing (4, 5).

8. Pump according to claim 4, wherein the shaft (17) carrying the rotor (7) runs on bearings in chassis (14) in such a manner that the rotor (13) of the drive motor (11) is situated between its bearings (18, 19).

9. Pump according to claim 8, wherein the chassis (14) and a can (21) form a gas-tight chamber (20) in which the motor's stator (12) is situated.

10. Pump according to claim 8, wherein a cone-shaped helical spring (22) is related to the face side of the shaft (17) on the side of the drive, said spring serving the purpose of generating the bearing forces.

11. Pump according to claim 16, wherein its housing is so designed that its opens out substantially cone-like from the inlet (2) to the side of the drive.

12. Pump according to claim 3, wherein the housing section (5) is equipped with a flat connection surface (24), on which a fore-vacuum connection (3), a plug (25) for a frequency converter and/or a venting connection (26) are situated.

13. Pump according to claim 12, wherein the connection surface (24) extends in parallel to the shaft (17).

14. Pump according to claim 12, wherein the connection surface (24) forms an angle with respect to the shaft (17) in such a manner that the connection surface (24) is enlarged and accessible from several sides.

* * * * *